US011456109B2

(12) United States Patent
Haseyama

(10) Patent No.: US 11,456,109 B2
(45) Date of Patent: Sep. 27, 2022

(54) COIL COMPONENT

(71) Applicant: TAIYO YUDEN CO., LTD., Tokyo (JP)

(72) Inventor: Takayuki Haseyama, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 304 days.

(21) Appl. No.: 16/898,000

(22) Filed: Jun. 10, 2020

(65) Prior Publication Data

US 2020/0395167 A1 Dec. 17, 2020

(30) Foreign Application Priority Data

Jun. 11, 2019 (JP) ..... JP2019-108371

(51) Int. Cl.

| | |
|---|---|
| ***H01F 27/28*** | (2006.01) |
| ***H01F 27/29*** | (2006.01) |
| ***H01F 41/04*** | (2006.01) |
| ***H01F 41/02*** | (2006.01) |
| ***H01F 27/24*** | (2006.01) |

(52) U.S. Cl.

CPC ..... *H01F 27/2804* (2013.01); *H01F 27/24* (2013.01); *H01F 27/292* (2013.01); *H01F 41/0206* (2013.01); *H01F 41/041* (2013.01); *H01F 2027/2809* (2013.01)

(58) Field of Classification Search

CPC .... H01F 27/2804; H01F 27/24; H01F 27/292; H01F 41/0206; H01F 41/041; H01F 2027/2809

USPC ..... 336/192

See application file for complete search history.

(56) References Cited

U.S. PATENT DOCUMENTS

2002/0014942 A1* 2/2002 Harding ..... H01F 27/2804 336/212
2002/0070835 A1* 6/2002 Dadafshar ..... H01F 27/2804 336/200
2016/0379745 A1* 12/2016 Hsiao ..... H01F 27/2804 336/200
2016/0380041 A1* 12/2016 Hsiao ..... H01F 41/046 257/531

FOREIGN PATENT DOCUMENTS

JP 2017-092505 A 5/2017

* cited by examiner

*Primary Examiner* — Alfonso Perez Borroto
(74) *Attorney, Agent, or Firm* — Pillsbury Winthrop Shaw Pittman, LLP

(57) ABSTRACT

A coil component includes a magnetic laminate, a coil conductor having conductor patterns disposed in the magnetic laminate and extending around the coil axis, and a cover layer disposed on one end of the magnetic laminate in the direction along the coil axis. The magnetic laminate includes first magnetic layers disposed between the conductor patterns, and second magnetic layers disposed between the first magnetic layers. The first magnetic layers contain first soft magnetic metal particles having a first average particle size, the second magnetic layers contain second soft magnetic metal particles having a second average particle size, the cover layer contains third soft magnetic metal particles having a third average particle size larger than the second average particle size. In the direction perpendicular to the coil axis A, the first magnetic layers project outward from the second magnetic layers, and the second magnetic layers project outward from the cover layer.

16 Claims, 7 Drawing Sheets

COIL COMPONENT

CROSS-REFERENCE TO RELATED APPLICATIONS

This application is based on and claims the benefit of priority from Japanese Patent Application Serial No. 2019-108371 (filed on Jun. 11, 2019), the contents of which are hereby incorporated by reference in their entirety.

TECHNICAL FIELD

The present invention relates to a coil component.

BACKGROUND

There are conventional coil components including a magnetic base body formed of a magnetic material, an external electrode provided on the surface of the magnetic base body, and a coil conductor provided in the magnetic base body. The conventional coil components are disclosed in, for example, Japanese Patent Application Publication No. 2017-092505. One example of coil components is an inductor. An inductor is a passive element used in an electronic circuit. For example, an inductor eliminates noise in a power source line or a signal line.

A coil component desirably has a small size. However, a small-sized coil component has a small contact area between the magnetic base body and the external electrode, causing the external electrode to fall off the magnetic base body.

SUMMARY

One object of the present invention is to provide a coil component having an improved joint strength between the magnetic base body and the external electrode. Other objects of the present invention will be made apparent through the entire description in the specification.

A coil component according to one embodiment of the present invention comprises: a coil conductor including a plurality of conductor patterns; a magnetic laminate formed of a plurality of first magnetic layers and a plurality of second magnetic layers stacked together in a lamination direction, the plurality of first magnetic layers being disposed between the plurality of conductor patterns and containing first soft magnetic metal particles having a first average particle size, the plurality of second magnetic layers being disposed around the plurality of conductor patterns between the plurality of first magnetic layers and containing second soft magnetic metal particles having a second average particle size, the second average particle size being larger than the first average particle size; a first external electrode disposed on a first end surface of the magnetic laminate and connected to one end of the coil conductor; and a second external electrode disposed on a second end surface of the magnetic laminate and connected to the other end of the coil conductor, the second end surface being opposed to the first end surface. In the embodiment, the plurality of first magnetic layers project outward from the plurality of second magnetic layers in a planar direction.

A coil component according to one embodiment of the present invention comprises a cover layer disposed on one end of the magnetic laminate in the lamination direction and containing third soft magnetic metal particles having a third average particle size that is larger than the second average particle size. In the embodiment, the plurality of second magnetic layers project outward from the cover layer in the planar direction.

A coil component according to one embodiment of the present invention comprises another cover layer disposed on the other end of the magnetic laminate in the lamination direction and containing fourth soft magnetic metal particles having a fourth average particle size that is larger than the second average particle size.

In one embodiment of the present invention, the second average particle size is two or more times as large as the first average particle size. In one embodiment of the present invention, the third average particle size is two or more times as large as the second average particle size. In one embodiment of the present invention, the third average particle size is within a range of 6 to 20 μm. In one embodiment of the present invention, the fourth average particle size is two or more times as large as the second average particle size. In one embodiment of the present invention, the fourth average particle size is within a range of 6 to 20 μm.

In one embodiment of the present invention, the coil conductor includes a first lead-out conductor extending through one of the plurality of second magnetic layers and connected to the first external electrode. In one embodiment of the present invention, the first lead-out conductor contacts with the cover layer.

In one embodiment of the present invention, the coil conductor includes a second lead-out conductor extending through one of the plurality of second magnetic layers and connected to the second external electrode. In one embodiment of the present invention, the second lead-out conductor contacts with the other cover layer.

A circuit board according to one embodiment of the present invention includes the above coil component.

An electronic device according to one embodiment of the present invention includes the above circuit board.

A method of producing a coil component according to one embodiment of the present invention comprises: preparing a plurality of magnetic sheets containing first soft magnetic metal particles having a first average particle size; providing a conductor pattern on each of the plurality of magnetic sheets; providing a magnetic film on each of the plurality of magnetic sheets to obtain a plurality of composite sheets, the magnetic film containing second soft magnetic metal particles having a second average particle size that is larger than the first average particle size; stacking together the plurality of composite sheets in a lamination direction to form a body laminate; firing the body laminate to obtain a fired laminate; dicing the fired laminate to obtain a chip laminate; polishing a first end surface and a second end surface of the chip laminate, the first end surface extending along the lamination direction, the second end surface being opposed to the first end surface; providing a first external electrode on the first end surface polished; and providing a second external electrode on the second end surface polished.

The method of producing a coil component according to one embodiment of the present invention further comprises preparing a cover layer sheet containing third soft magnetic metal particles having a third average particle size that is larger than the second average particle size, In forming the body laminate, the plurality of composite sheets may be stacked together with the cover layer sheet in the lamination direction such that the cover layer sheet is positioned on one end in the lamination direction.

Advantageous Effects

The present invention improves the joint strength between the magnetic base body and the external electrode.

BRIEF DESCRIPTION OF THE DRAWINGS

FIG. 4A is an enlarged longitudinal sectional view of a chip laminate before polishing.

FIG. 4B is an enlarged longitudinal sectional view of the chip laminate after polishing.

DESCRIPTION OF THE EMBODIMENTS

Various embodiments of the present invention will be hereinafter described with reference to the drawings. Elements common to a plurality of drawings are denoted by the same reference signs throughout the plurality of drawings. It should be noted that the drawings do not necessarily appear to an accurate scale for convenience of explanation.

Figure 1:
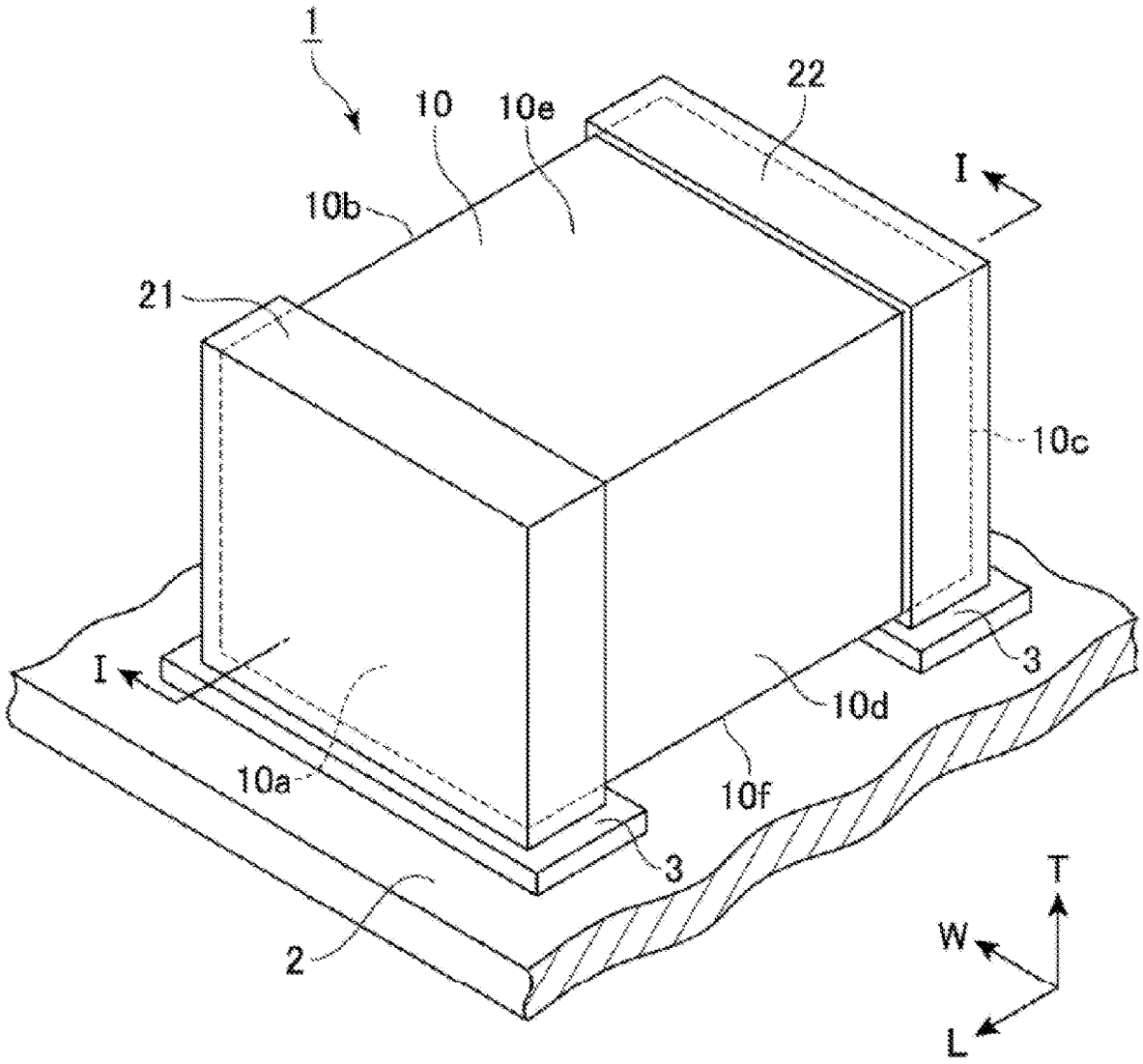
FIG. 1 is a perspective view of a coil component according to one embodiment of the present invention.
Figure 2:
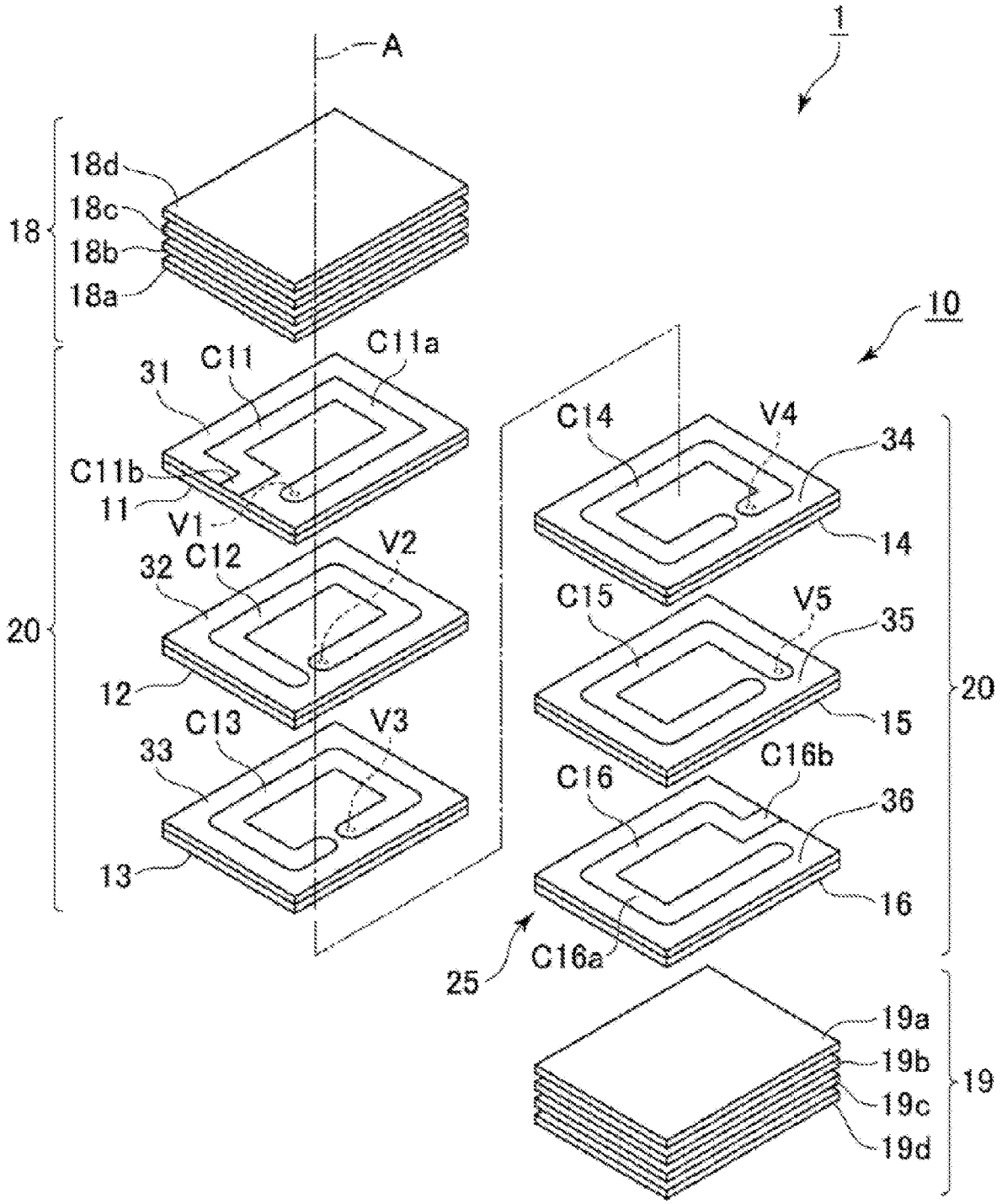
FIG. 2 is an exploded perspective view of the coil component shown in FIG. 1.

FIG. 1 is a perspective view of a coil component 1 according to one embodiment of the present invention, and FIG. 2 is an exploded perspective view of the coil component 1 shown in FIG. 1. In FIG. 2, the external electrode 21 and the external electrode 22 (described later) are omitted for convenience of illustration. By way of one example of the coil component 1, FIGS. 1 and 2 show a laminated inductor used as a passive element in various circuits. A laminated inductor is one example of a coil component to which the present invention is applicable. The present invention is applicable to a power inductor incorporated in a power source line and to various other coil components.

The coil component 1 in the embodiment shown includes a magnetic base body 10 containing a plurality of soft magnetic metal particles, a coil conductor 25 disposed in the magnetic base body 10 and extending around a coil axis A, an external electrode 21 electrically connected to one end of the coil conductor 25, and an external electrode 22 electrically connected to the other end of the coil conductor 25.

The coil component 1 is mounted on a circuit board 2. The circuit board 2 may have land portions 3 provided thereon. The coil component 1 may be mounted on the circuit board 2 by joining the external electrodes 21,22 to the corresponding land portions 3 of the circuit board 2. The circuit board 2 can be installed in various electronic devices. Examples of an electronic device including the circuit board 2 on which the coil component 1 is mounted include a smartphone, a mobile phone, a tablet terminal, a game console, and any other electronic device that can include the circuit board 2 on which the coil component 1 is mounted.

In one embodiment of the present invention, the magnetic base body 10 is formed in a substantially rectangular parallelepiped shape. The magnetic base body 10 has a first principal surface 10*e*, a second principal surface 10*f*, a first end surface 10*a*, a second end surface 10*c*, a first side surface 10*b*, and a second side surface 10*d*. The outer surface of the magnetic base body 10 is defined by these six surfaces. The first principal surface 10*e* and the second principal surface 10*f* are opposed to each other, the first end surface 10*a* and the second end surface 10*c* are opposed to each other, and the first side surface 10*b* and the second side surface 10*d* are opposed to each other. The first end surface 10*a*, the second end surface 10*c*, the first side surface 10*b*, and the second side surface 10*d* extend in the axial direction along the coil axis A. The first end surface 10*a* and the second end surface 10*c* are connected to each other via the first principal surface 10*e*, the second principal surface 10*f*, the first side surface 10*b*, and the second side surface 10*d*. In a case where the magnetic base body 10 is formed in a rectangular parallelepiped shape, the first principal surface 10*e* and the second principal surface 10*f* are parallel to each other, the first end surface 10*a* and the second end surface 10*c* are parallel to each other, and the first side surface 10*b* and the second side surface 10*d* are parallel to each other.

In the embodiment of FIG. 1, the first principal surface 10*e* lies on a top side of the magnetic base body 10, and therefore, it may be herein referred to as "the top surface." Similarly, the second principal surface 10*f* may be referred to as "the bottom surface." The coil component 1 is disposed such that the second principal surface 10*f* faces the circuit board (not shown), and therefore, the second principal surface 10*f* may be herein referred to as "the mounting surface." The top-bottom direction of the coil component 1 is based on the top-bottom direction in FIG. 1.

In this specification, a "length" direction, a "width" direction, and a "thickness" direction of the coil component 1 are referred to as an "L axis" direction, a "W axis" direction, and a "T axis" direction in FIG. 1, respectively, unless otherwise construed from the context. The L axis, the W axis, and the T axis are perpendicular to one another. The coil axis A extends in the T axis direction. Various layers included in the coil component 1 (for example, first magnetic layers 11 to 16 and second magnetic layers 31 to 36) are stacked together in the direction along the coil axis A. The direction along the coil axis A may be herein referred to as "the lamination direction." The coil axis A intersects the first principal surface 10*e* and the second principal surface 10*f*. The direction perpendicular to the coil axis A is herein referred to as "the planar direction." The direction in which the plane containing the W axis direction and the L axis direction extends is the planar direction.

In one embodiment of the present invention, the coil component 1 has a length (the dimension in the L axis direction) of 0.2 to 6.0 mm, a width (the dimension in the W axis direction) of 0.1 to 4.5 mm, and a thickness (the dimension in the T axis direction) of 0.1 to 4.0 mm. These dimensions are mere examples, and the coil component 1 to which the present invention is applicable can have any dimensions that conform to the purport of the present invention. In one embodiment, the coil component 1 has a low profile. For example, the coil component 1 has a width larger than the thickness thereof.

The coil conductor 25 is constituted by the conductor patterns C11 to C16 and the vias V1 to V5. The conductor patterns C11 to C16 extend around the coil axis A along the planar direction perpendicular to the coil axis A and are separated from each other in the direction along the coil axis A. The vias V1 to V5 extend in the axial direction along the coil axis A. The conductor patterns C11 to C16 are each electrically connected to adjacent one of these conductor patterns via the vias V1 to V5, and the conductor patterns C11 to C16 connected together in this manner constitute the coil conductor 25. The conductor pattern C11 is opposed to the first principal surface 10*e*, and the conductor pattern C16 is opposed to the second principal surface 10*f*.

The external electrode 21 and the external electrode 22 are provided on the surface of the magnetic base body 10. In one embodiment, the external electrode 21 contacts at least with the first end surface 10*a* of the magnetic base body 10, and the external electrode 22 contacts at least with the second end surface 10*c* of the magnetic base body 10. The external electrode 21 covers either the whole or a part of the first end surface 10*a*. Likewise, the external electrode 22 covers either the whole or a part of the second end surface 10*c*. The external electrode 21 is spaced from the external electrode 22 in the L axis direction for electrical insulation from the external electrode 22. The shapes of the external electrodes 21, 22 applicable to the present invention are not limited to the illustrated examples. For example, at least one of the external electrodes 21, 22 may either include or not include a flange portion extending along the first principal surface 10*e* of the magnetic base body 10.

As shown in FIG. 2, the magnetic base body 10 includes a magnetic laminate 20, a top cover layer 18 provided on the top-side surface of the magnetic laminate 20, and a bottom cover layer 19 provided on the bottom-side surface of the magnetic laminate 20. The magnetic laminate 20 includes a plurality of first magnetic layers 11 to 16. The coil component 1 shown includes the bottom cover layer 19, the magnetic laminate 20, and the top cover layer 18 that are stacked in this order in the lamination direction along the coil axis A from the bottom to the top in FIG. 2.

The top cover layer 18 includes four magnetic layers 18*a* to 18*d*. The top cover layer 18 includes the magnetic layer 18*a*, the magnetic layer 18*b*, the magnetic layer 18*c*, and the magnetic layer 18*d* that are stacked in this order from the bottom to the top in FIG. 2.

The bottom cover layer 19 includes four magnetic layers 19*a* to 19*d*. The bottom cover layer 19 includes the magnetic layer 19*a*, the magnetic layer 19*b*, the magnetic layer 19*c*, and the magnetic layer 19*d* that are stacked in this order from the top to the bottom in FIG. 2.

In another embodiment of the present invention, the first magnetic layers 11 to 16 may be stacked together in the L axis direction. In this case, since the conductor patterns C11 to C16 are formed on the surfaces of the first magnetic layers 11 to 16, respectively, the coil axis A is oriented in the L axis direction, which is the same as the lamination direction of the first magnetic layers 11 to 16. In another embodiment of the present invention, the first magnetic layers 11 to 16 may be stacked together in the W axis direction. In this case, since the conductor patterns C11 to C16 are formed on the surfaces of the first magnetic layers 11 to 16, respectively, the coil axis A is oriented in the W axis direction, which is the same as the lamination direction of the first magnetic layers 11 to 16.

In one embodiment, the first magnetic layers 11 to 16, the magnetic layers 18*a* to 18*d*, and the magnetic layers 19*a* to 19*d* are formed by binding together a multitude of soft magnetic metal particles each having an insulating film formed on the surface thereof. The insulating film is, for example, an oxide film formed by oxidizing a surface of a soft magnetic metal. Examples of soft magnetic metal particles applicable to the present invention include particles of an Fe—Si—Cr, Fe—Si—Al, or Fe—Ni alloy, an Fe—Si—Cr—B—C or Fe—Si—B—Cr amorphous alloy, Fe, or a mixture of these materials. The regions of the first magnetic layers 11 to 16 that overlap in plan view with the conductor patterns C11 to C16, respectively, may be formed of a non-magnetic material. In such arrangement, each of the first magnetic layers 11 to 16 is a mixture layer including a core region formed of a magnetic material, a side margin region formed of a magnetic material, and an overlapping region formed of a non-magnetic material. The core region is positioned inside the inner end of the corresponding one of the conductor patterns C11 to C16 in the planer direction, the side margin region is positioned outside the outer end of the corresponding one of the conductor patterns C11 to C16 in the planer direction, and the overlapping region is the region overlapping with the corresponding one of the conductor patterns C11 to C16 (that is, the region between the core region and the side margin region in the planer direction). Examples of the non-magnetic material used for the first magnetic layers 11 to 16 include various resin materials (for example, a polyimide resin, an epoxy resin, and other resin materials), various dielectric ceramics (borosilicate glass, a mixture of borosilicate glass and crystalline silica, and other dielectric ceramics), and various non-magnetic ferrite materials (for example, Zn—Cu-based ferrite). Since the regions of the first magnetic layers 11 to 16 that overlap in plan view with the conductor patterns C11 to C16, respectively, are formed of a non-magnetic material, it is possible to suppress the leakage flux passing between the conductor patterns C11 to C16 and thus improve the magnetic characteristics of the coil component 1.

The coil component 1 can include any number of magnetic layers as necessary in addition to the first magnetic layers 11 to 16, the magnetic layers 18*a* to 18*d*, and the magnetic layers 19*a* to 19*d*. Some of the first magnetic layers 11 to 16, the magnetic layers 18*a* to 18*d*, and the magnetic layers 19*a* to 19*d* can be omitted as appropriate.

The first magnetic layers 11 to 16 have the conductor patterns C11 to C16, respectively, formed on the top-side surfaces thereof. The conductor patterns C11 to C16 extend around the coil axis A. The direction of the coil axis A is the same as the lamination direction of the first magnetic layers 11 to 16. Around the conductor patterns C11 to C16, there are provided second magnetic layers 31 to 36. More specifically, the second magnetic layers 31 to 36 are disposed in the regions outside the conductor patterns C11 to C16 in the planar direction (the regions more distant from the coil axis A). As shown, the second magnetic layers 31 to 36 may also be disposed inside the conductor patterns C11 to C16 in the planar direction.

The first magnetic layers 11 to 15 are provided with vias V1 to V5, respectively, at predetermined locations therein. The vias V1 to V5 are formed by forming through-holes at the predetermined locations in the first magnetic layers 11 to 15 so as to extend through the first magnetic layers 11 to 15 in the T axis direction and filling the through-holes with a metal material.

The conductor patterns C11 to C16 and the vias V1 to V5 are formed of a metal material having an excellent electrical conductivity, such as Ag, Pd, Cu, or Al, or any alloy of these metals.

The specific materials mentioned herein are examples, and other suitable materials not mentioned herein can also be used as materials of the constituent elements of the coil component 1.

Figure 3:
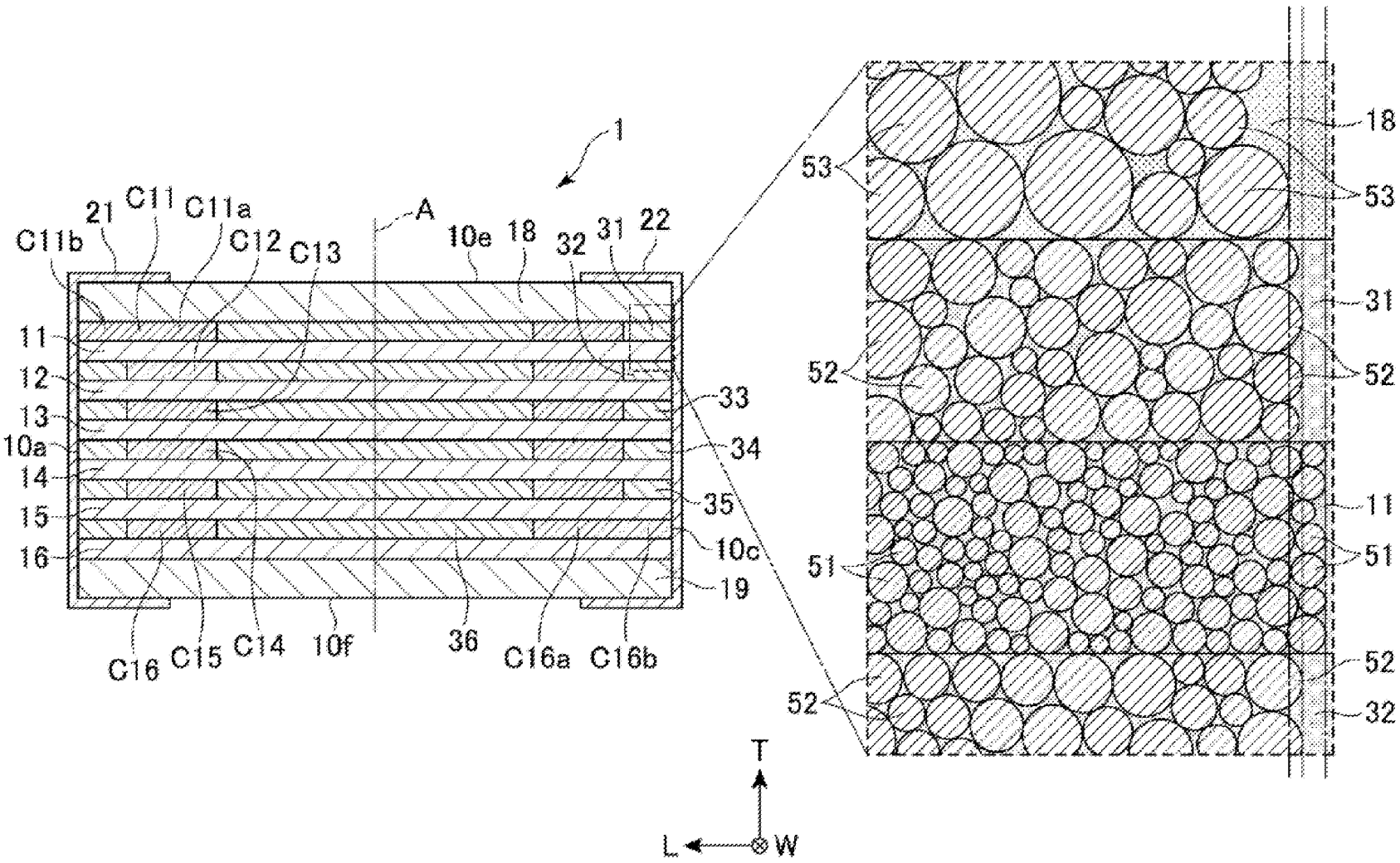
FIG. 3 schematically shows a longitudinal section of the coil component along the line I-I in FIG. 1.
Figure 4A:
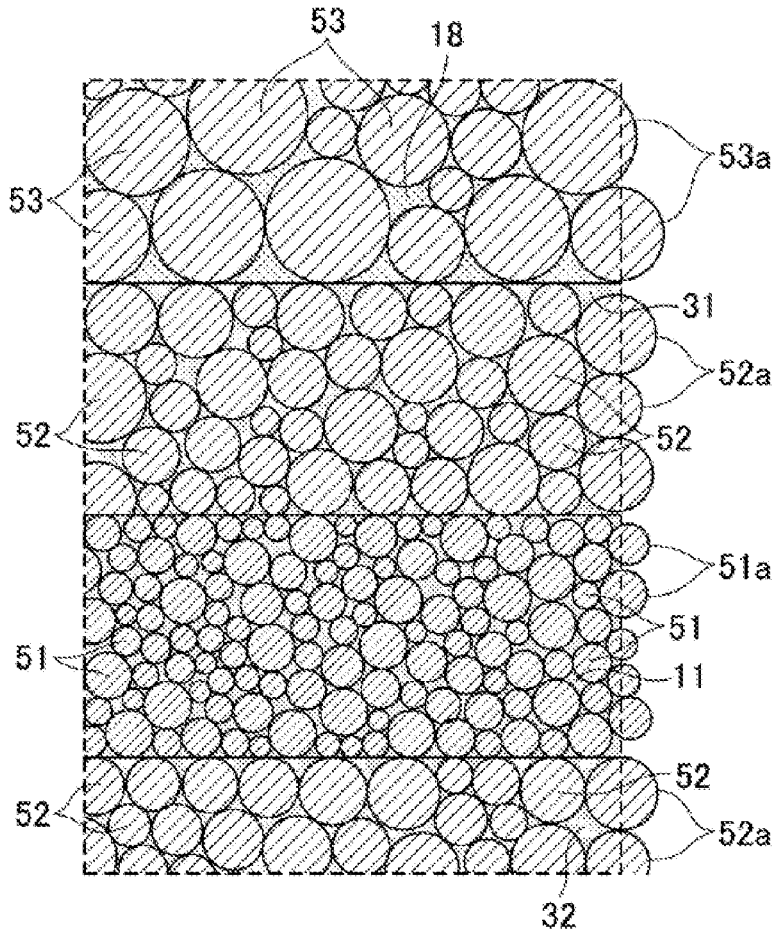
FIG. 4A schematically illustrates a part of a production process of the coil component of FIG. 1. More specifically.
Figure 4B:
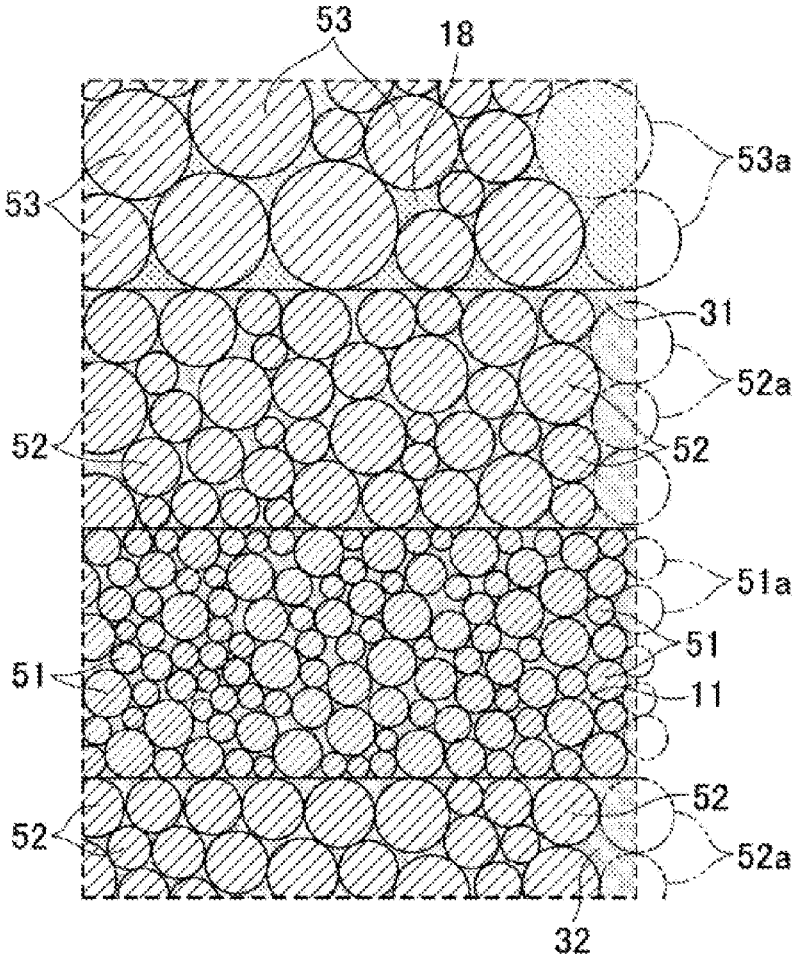
FIG. 4B schematically illustrates a part of the production process of the coil component of FIG. 1. More specifically.

Next, with reference to FIGS. 3, 4A, and 4B, a further description is given of the lamination structure of the coil component 1. FIG. 3 schematically shows a longitudinal section of the coil component 1 along the line I-I in FIG. 1, and FIGS. 4A and 4B each schematically illustrate a part of the production process of the coil component 1. FIG. 3 includes a drawing showing an entire longitudinal section of the magnetic base body 10, as well as an enlarged drawing of a partial region of the longitudinal section (that is, partial regions of the first magnetic layer 11, the second magnetic layer 31, the top cover layer 18, and the second magnetic layer 32). As shown in FIG. 3, the magnetic base body 10 includes the magnetic laminate 20, the top cover layer 18, and the bottom cover layer 19. The top cover layer 18 is provided on the top-side end of the magnetic laminate 20 in the axial direction along the coil axis A, and the bottom cover layer 19 is provided on the bottom-side end of the magnetic laminate 20 in the axial direction. The magnetic laminate 20 includes the plurality of conductor patterns C11 to C16, the first magnetic layers 11 to 16, and the second magnetic layers 31 to 36. The plurality of conductor patterns C11 to C16 are separated from each other in the axial direction, the first magnetic layers 11 to 16 are provided between the plurality of conductor patterns C11 to C16, and the second magnetic layers 31 to 36 are provided between the first magnetic layers 11 to 16. As described above, the second magnetic layers 31 to 36 are disposed around the conductor patterns C11 to C16 in the planar direction perpendicular to the coil axis A. In the embodiment shown, the second magnetic layers 31 to 36 are also disposed inside the conductor patterns C11 to C16.

The magnetic base body 10 contains a plurality of soft magnetic metal particles. In the magnetic base body 10, the first magnetic layers 11 to 16 each contain a plurality of first soft magnetic metal particles 51 having a first average particle size, the second magnetic layers 31 to 36 each contain a plurality of second soft magnetic metal particles 52 having a second average particle size, the top cover layer 18 contains a plurality of third soft magnetic metal particles 53 having a third average particle size, and the bottom cover layer 19 contains fourth soft magnetic metal particles having a fourth average particle size. The second average particle size is larger than the first average particle size. The third average particle size is larger than the second average particle size. The fourth average particle size is larger than the second average particle size. In one embodiment, the second average particle size is two or more times as large as the first average particle size. In one embodiment, the third average particle size is two or more times as large as the second average particle size. In one embodiment, the fourth average particle size is two or more times as large as the second average particle size. It should be noted that the magnetic particles shown in FIGS. 3, 4A, and 4B do not necessarily appear to an accurate scale, so as to emphasize the difference in average particle size.

Each of the first average particle size, the second average particle size, the third average particle size, and the fourth average particle size is 50 μm or smaller. When the unevenness in the outer surface of the magnetic base body exceeds 50 μm in height, a gap tends to be formed between the external electrode 21 and the first end surface 10*a* and between the external electrode 22 and the second end surface 10*c* of the magnetic base body 10. Moisture or the like entering the gap causes the external electrodes to degrade and fall off. With the first magnetic particles having an average particle size of 50 μm or smaller, the outer surface of the magnetic base body is flat and no gap is formed between the magnetic base body and the external electrodes, preventing moisture or the like from entering a gap to cause degradation of the joint strength. This prevents the external electrodes from falling off. By way of an example, the first average particle size is within the range of 0.5 to 4 μm. For example, the second average particle size is within the range of 2 to 10 μm. For example, the third average particle size is within the range of 6 to 20 μm. For example, the fourth average particle size is within the range of 6 to 20 μm.

The term "average particle size" of soft magnetic metal particles herein refers to a volume-based average particles size, unless otherwise construed. The volume-based average particle size of the soft magnetic metal particles is measured by the laser diffraction scattering method in conformity to JIS Z 8825. An example of the devices for the laser diffraction scattering method is the laser diffraction/scattering particle size distribution measuring device LA-960 from HORIBA Ltd., at Kyoto city, Kyoto, Japan.

In one embodiment, the first magnetic layers 11 to 16 each project outward from the adjacent ones of the second magnetic layers 31 to 36 in the planar direction (away from the coil axis A in the planar direction). For example, in the embodiment shown in FIG. 3, the first magnetic layer 11 projects outward from the second magnetic layer 31 and the second magnetic layer 32 in the planar direction perpendicular to the coil axis A. More specifically, in the planar direction, the outermost particles among the plurality of first soft magnetic metal particles 51 contained in the first magnetic layer 11 are positioned on an outer side of the outermost particles among the plurality of second soft magnetic metal particles 52 contained in the second magnetic layer 31 and the outermost particles among the plurality of second soft magnetic metal particles 52 contained in the second magnetic layer 32.

In one embodiment, the second magnetic layer 31 projects outward from the top cover layer 18 in the planar direction. More specifically, in the planar direction, the outermost particles among the plurality of second soft magnetic metal particles 52 contained in the second magnetic layer 31 are positioned on an outer side of the outermost particles among the plurality of third soft magnetic metal particles 53 contained in the top cover layer 18.

In one embodiment, the first magnetic layer 16 may be omitted. In this case, the second magnetic layer 36 and the conductor pattern C16 contact with the bottom cover layer 19. The second magnetic layer 36 may project outward from the bottom cover layer 19 in the planar direction.

In another embodiment, the second magnetic layer 31 may not project outward from the top cover layer 18 in the planar direction. For example, the outer end of the second magnetic layer 31 in the planar direction may be aligned with the outer end of the top cover layer 18 in the planar direction. The second magnetic layer 31 may be recessed inward from the top cover layer 18 in the planar direction. The second magnetic layer 36 may not project outward from the bottom cover layer 19 in the planar direction. For example, the outer end of the second magnetic layer 36 in the planar direction may be aligned with the outer end of the bottom cover layer 19 in the planar direction. The second magnetic layer 36 may be recessed inward from the bottom cover layer 19 in the planar direction.

As shown in FIG. 3, the conductor pattern C11 includes a circumferential portion C11*a* and a lead-out conductor C11*b*. The circumferential portion C11*a* extends around the coil axis A, and the lead-out conductor C11*b* extends from one end of the circumferential portion C11*a* to the external electrode 21. The conductor pattern C11 is connected to the external electrode 21 at the lead-out conductor C11*b*. The lead-out conductor C11*b* extends from one end of the circumferential portion C11*a* to the external electrode 21 through the second magnetic layer 31. The top-side surface of the lead-out conductor C11*b* contacts with the top cover layer 18.

Similarly to the conductor pattern C11, the conductor pattern C16 includes a circumferential portion C16*a* and a lead-out conductor C16*b*. The circumferential portion C16*a* extends around the coil axis A, and the lead-out conductor C16*b* extends from one end of the circumferential portion C16*a* to the external electrode 22. The conductor pattern C16 is connected to the external electrode 22 at the lead-out conductor C16*b*. The lead-out conductor C16*b* extends from one end of the circumferential portion C16*a* to the external electrode 22 through the second magnetic layer 36. As described above, the first magnetic layer 16 may be omitted. In this case, the bottom-side surface of the lead-out conductor 16*b* contacts with the bottom cover layer 19

Next, a description is given of an example of a production method of the coil component 1. The first step is to prepare a plurality of magnetic sheets to be the first magnetic layers 11 to 16. These magnetic sheets are formed by, for example, applying a slurry to a surface of a plastic base film using a known method such as the doctor blade method, drying the slurry, and cutting the dried slurry to a predetermined size. The slurry is made by mixing and kneading the first soft magnetic metal particles 51 described above with a resin material having an excellent insulating quality such as polyvinyl butyral (PVB) resin or epoxy resin and a solvent.

Next, through-holes for vias are formed in the above magnetic sheets. A conductive paste containing a conductive metal such as Ag, an Ag alloy, Cu, or a Cu alloy is printed by screen printing or other methods on the plurality of magnetic sheets each having the through hole formed therein, so as to form unfired conductor patterns to be the conductor patterns C11 to C16. At this time, the through-hole formed in each magnetic sheet is filled with the conductive paste. This process produces, in the first magnetic layers 11 to 16, the unfired conductor patterns to be the conductor patterns C11 to C16 and the vias V1 to V5. The conductor patterns and the vias can be formed by any various known methods other than the screen printing. Next, a slurry is applied to the regions of the magnetic sheets where the unfired conductor patterns are absent, to form magnetic films to be the second magnetic layers 31 to 36. This slurry is made by mixing and kneading the second soft magnetic metal particles 52 described above with a resin material and a solvent. In this way, the unfired conductor patterns and the magnetic films are formed on the magnetic sheets to obtain composite sheets. These composite sheets are stacked together to obtain an intermediate laminate to be the magnetic laminate 20.

The next step is to prepare cover layer sheets to be the magnetic layers 18*a* to 18*d* and the magnetic layers 19*a* to 19*d*. The cover layer sheets are formed in the same manner as the magnetic sheets. The cover layer sheets are formed by, for example, applying a slurry to a surface of a plastic base film using a known method such as the doctor blade method, drying the slurry, and cutting the dried slurry to a predetermined size. The slurry used for the magnetic layers 18*a* to 18*d* contains the third soft magnetic metal particles 53 described above. The slurry used for the magnetic layers 19*a* to 19*d* contains the fourth soft magnetic metal particles described above. The cover layer sheets prepared in this manner are stacked together to form a top laminate to be the top cover layer 18 and a bottom laminate to be the bottom cover layer 19. The fourth soft magnetic metal particles may be the same as the third soft magnetic metal particles 53. The top laminate is formed by stacking together a plurality of cover layer sheets that are to be the magnetic layers 18*a* to 18*d*. The bottom laminate is formed by stacking together a plurality of cover layer sheets that are to be the magnetic layers 19*a* to 19*d*.

Next, the bottom laminate, the intermediate laminate, and the top laminate are stacked together in the stated order in the direction of the T axis from the negative side to the positive side, and these stacked laminates are bonded together by thermal compression using a pressing machine to produce a body laminate.

Next, the body laminate is diced to a desired size using a cutter such as a dicing machine or a laser processing machine to produce a chip laminate. Next, the chip laminate is degreased and then heated.

The surfaces of the heated chip laminate that correspond to the first end surface 10*a* and the second end surface 10*c*, respectively, are polished by barrel polishing or other polishing technique. As shown in FIGS. 4A and 4B, this polishing treatment is performed to remove soft magnetic metal particles exposed from the end of the chip laminate. FIGS. 4A and 4B are enlarged longitudinal sectional views of a chip laminate showing a part of the longitudinal section of the chip laminate (corresponding to the enlarged region in FIG. 3). FIG. 4A shows the chip laminate before polishing, and FIG. 4B shows the chip laminate after polishing. As shown in FIG. 4B, in the first magnetic layer 11, the polishing treatment removes the first soft magnetic metal particles 51*a* that are exposed from the chip laminate among the first soft magnetic metal particles 51 contained in the first magnetic layer 11. Likewise, in the second magnetic layer 31 and the second magnetic layer 32, the polishing treatment removes the second soft magnetic metal particles 52*a* that are exposed from the chip laminate among the second soft magnetic metal particles 52 contained in the second magnetic layer 31 and the second magnetic layer 32. In the top cover layer 18, the polishing treatment removes the third soft magnetic metal particles 53*a* that are exposed from the chip laminate among the third soft magnetic metal particles 53 contained in the top cover layer 18. It is possible that a plurality of soft magnetic metal particles are removed from one layer.

Next, a conductive paste is applied to each of the polished surfaces of the chip laminate (the surface corresponding to the first end surface 10*a* and the surface corresponding to the second end surface 10*c*) to form the external electrodes 21 and 22. At least one of a solder barrier layer and a solder wetting layer may be formed on the external electrode 21 and the external electrode 22 as necessary. The coil component 1 is obtained, as described above.

A part of the steps included in the above production method may be omitted as necessary. In the production method of the coil component 1, steps not described explicitly in this specification may be performed as necessary. A part of the steps included in the production method of the coil component 1 may be performed in different order within the purport of the present invention. A part of the steps included in the production method of the coil component 1 may be performed at the same time or in parallel, if possible. The coil component 1 may be produced by methods known to those skilled in the art other than the sheet lamination method described above. One example of such methods is the thin film process.

Figure 5:
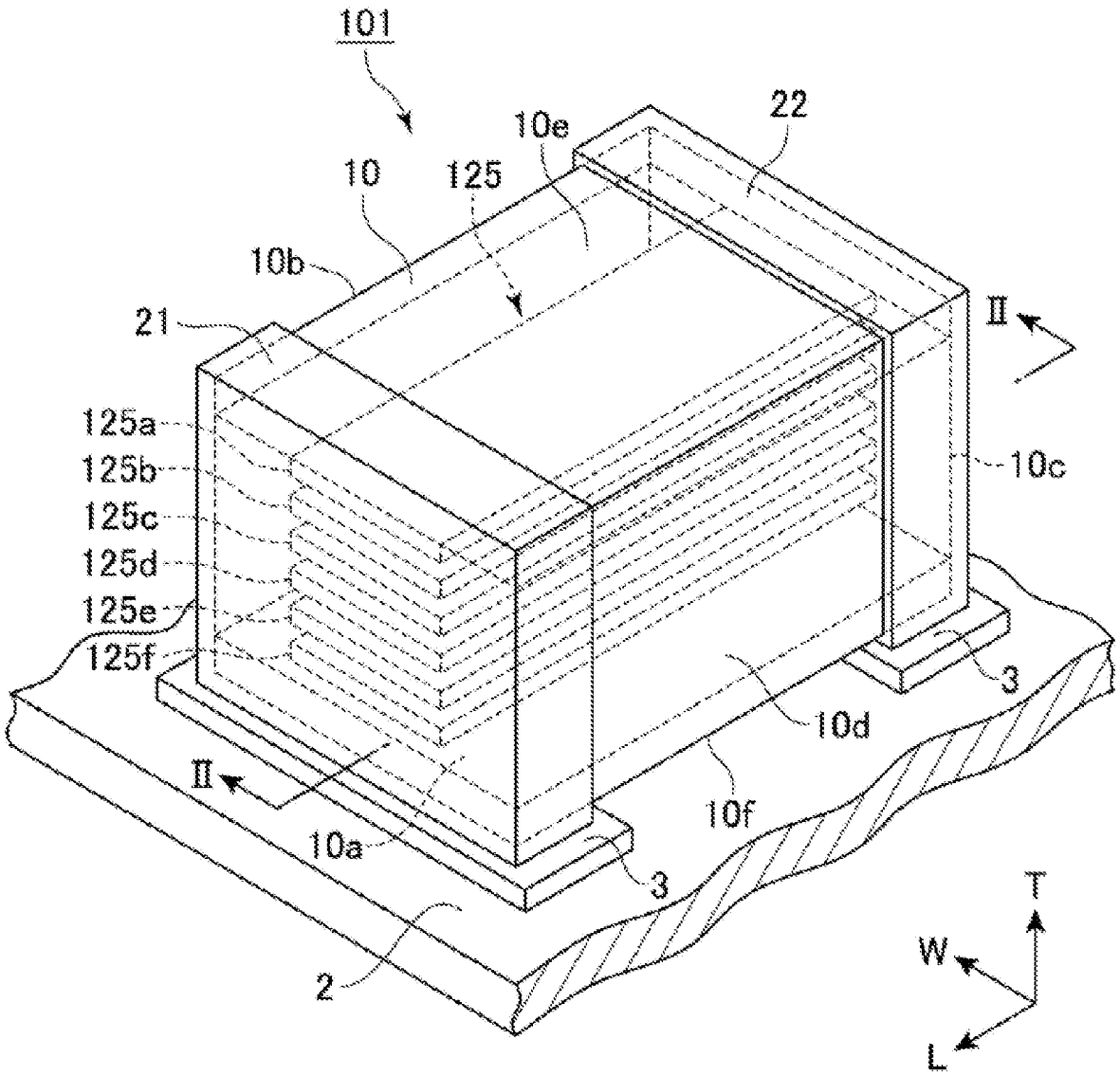
FIG. 5 is a perspective view of a coil component according to another embodiment of the present invention.
Figure 6:
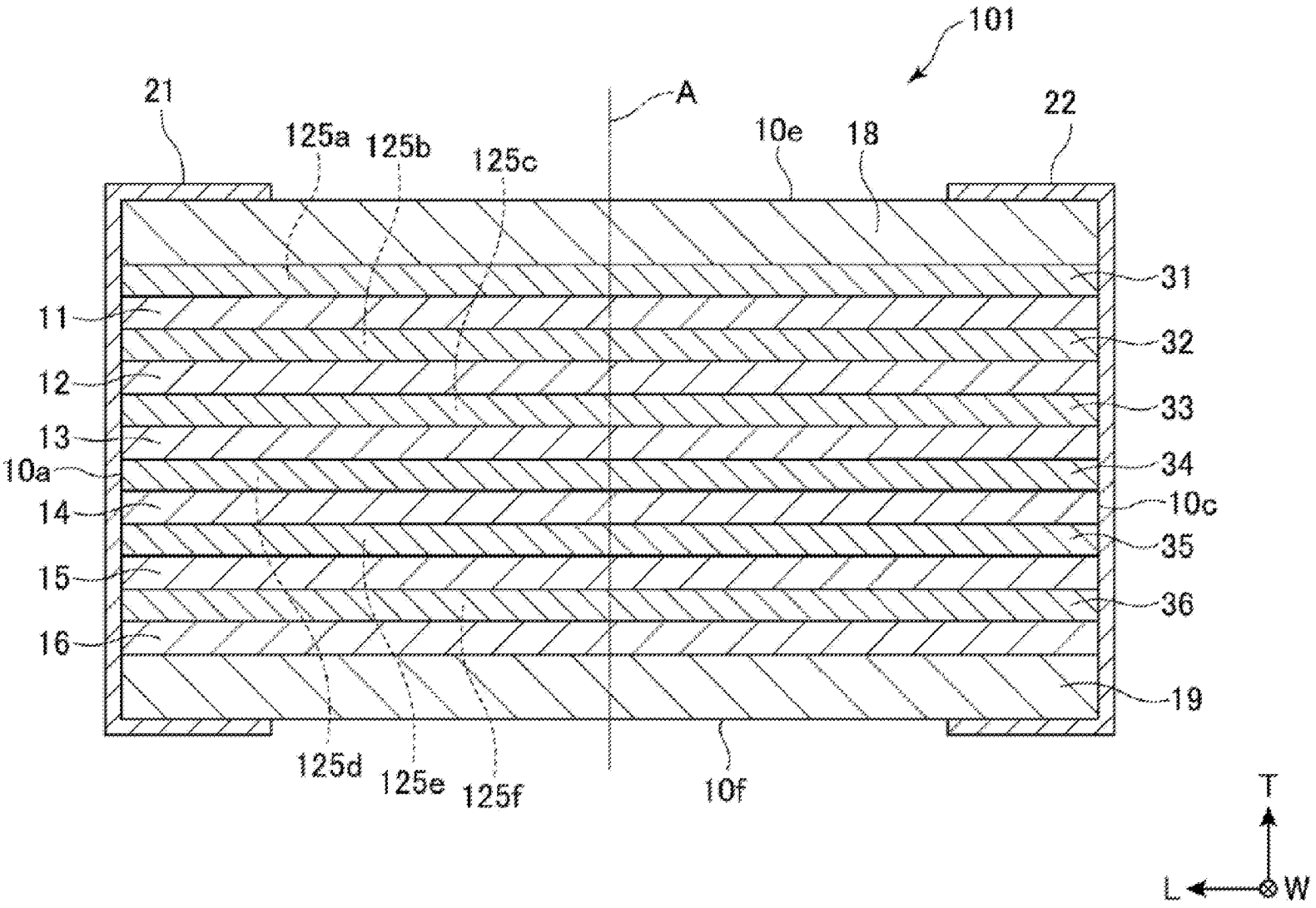
FIG. 6 schematically shows a longitudinal section of the coil component along the line II-II in FIG. 5.

Next, a coil component 101 according to another embodiment of the present invention will be described with reference to FIGS. 5 and 6. FIG. 5 is a schematic perspective view of the coil component 101, and FIG. 6 schematically shows a longitudinal section of the coil component 101 cut along the line II-II. In FIG. 5, the line II-II cuts the coil component 101 at a location spaced toward the negative side of the W axis direction from the center of the coil component 101 in the W axis direction.

The coil component 101 is different from the coil component 1 in that it includes a coil conductor 125 instead of the coil conductor 25. The coil conductor 125 includes a plurality of conductor portions. In the embodiment shown, the coil conductor 125 includes six conductor portions, the conductor portions 125*a* to 125*f*. As shown in FIGS. 5 and 6, the conductor portions 125*a* to 125*f* of the coil conductor 125 extend linearly from the external electrode 21 to the external electrode 22 in plan view. That is, each of the conductor portions 125*a* to 125*f* has no parts that are opposed to each other in the magnetic base body 10. Herein, when each of the conductor portions 125*a* to 125*f* has no parts that are opposed to each other in the magnetic base body 10 in plan view, the conductor portions 125*a* to 125*f* are regarded as extending linearly from the external electrode 21 to the external electrode 22. Therefore, in the coil component 101, the magnetic base body 10 is required to have a lower insulation reliability (dielectric strength) than in the coil component including an internal conductor having parts opposed to each other (for example, the conductor pattern C11 of the coil component 1, which extends in the circumferential direction around the coil axis A, has parts opposed to each other in plan view).

Advantageous effects of the above embodiments will be now described. In the above embodiments, at least one of the first magnetic layers 11 to 16 projects outward from the second magnetic layers 31 to 36 in the planar direction perpendicular to the coil axis A, and at least one of the second magnetic layers 31 to 36 projects outward from the cover layer in the planar direction. Therefore, the magnetic base body 10 has unevenness in the first end surface 10*a* having the external electrode 21 mounted thereon and the second end surface 10*c* having the external electrode 22 mounted thereon. This produces the anchor effect that allows the external electrode 21 and the external electrode 22 to be attached more securely to the first end surface 10*a* and the second end surface 10*c* of the magnetic base body 10.

In the above embodiment, the chip laminate is polished to remove the soft magnetic metal particles exposed from the end of the chip laminate. The first average particle size of the first soft magnetic metal particles 51 contained in the first magnetic layers 11 to 16 is smaller than the second average particle size of the second magnetic metal particles 52 contained in the second magnetic layers 31 to 36, and the second average particle size is smaller than the third average particle size of the third soft magnetic metal particles 53 contained in the top cover layer 18. Therefore, when these soft magnetic metal particles are removed by polishing, the surface of the chip laminate (that is, the first end surface 10*a* and the second end surface 10*c* of the magnetic base body 10) can have unevenness with a height of about the diameter of the soft magnetic metal particles removed therefrom. Because of the relationship between the particle sizes in these layers, the first magnetic layers 11 to 16 of the chip laminate, which project the most outward, can have small unevenness, thereby reducing the variation of the outer size of the chip laminate. Further, because of the relationship between the particles sizes in these layers, the height of the unevenness formed in the first end surface 10*a* and the second end surface 10*c* of the magnetic base body 10 by removal of the soft magnetic metal particles is equal to or smaller than the diameter of the third soft magnetic metal particles 53 which have the largest diameter. In one embodiment, the third average particle size is within the range of 6 to 20 μm, and therefore, the height of the unevenness formed in the first end surface 10*a* and the second end surface 10*c* of the magnetic base body 10 by polishing is mostly 20 μm or smaller. The unevenness with a height of 20 μm or smaller produces the anchor effect and produces no gap that reduces the joint strength between the magnetic base body 10 and the external electrodes 21, 22. This allows the external electrode 21 and the external electrode 22 to be attached more securely to the first end surface 10*a* and the second end surface 10*c* of the magnetic base body 10.

In the above embodiment, the top-side surface of the lead-out conductor C11*b* contacts with the top cover layer 18. The top cover layer 18 is recessed inward (toward the coil axis A) from the first magnetic layer 11 in the planar direction, and therefore, a large contact area can be obtained between the external electrode 21 and the top-side surface of the lead-out conductor C11*b*. This reduces the direct current resistance (Rdc) of the coil conductor 25. When the first magnetic layer 16 is omitted and the bottom-side surface of the lead-out conductor C16*b* contacts with the bottom cover layer 19, the bottom cover layer 19 is recessed inward from the first magnetic layer 15 in the planar direction, and therefore, a large contact area can be obtained between the external electrode 22 and the bottom-side surface of the lead-out conductor C16*b*. This reduces the direct current resistance (Rdc) of the coil conductor 25.

In the above embodiment, the coil component 1 has a higher joint strength between the magnetic base body 10 and the external electrodes 21, 22, and therefore, the coil component 1 can be prevented from falling off the circuit board 2. An electronic device including the circuit board 2 is free from failure caused by falling-off of the coil component 1.

The dimensions, materials, and arrangements of the constituent elements described herein are not limited to those explicitly described for the embodiments, and these constituent elements can be modified to have any dimensions, materials, and arrangements within the scope of the present invention. Furthermore, constituent elements not explicitly described herein can also be added to the described embodiments, and it is also possible to omit some of the constituent elements described for the embodiments.

What is claimed is:

1. A coil component comprising:

a coil conductor including a plurality of conductor patterns;

a magnetic laminate formed of a plurality of first magnetic layers and a plurality of second magnetic layers stacked together in a lamination direction, the plurality of first magnetic layers being disposed between the plurality of conductor patterns and containing first soft magnetic metal particles having a first average particle size, the plurality of second magnetic layers being disposed around the plurality of conductor patterns between the plurality of first magnetic layers and containing second soft magnetic metal particles having a second average particle size, the second average particle size being larger than the first average particle size;

a first external electrode disposed on a first end surface of the magnetic laminate and connected to one end of the coil conductor; and a second external electrode disposed on a second end surface of the magnetic laminate and connected to the other end of the coil conductor, the second end surface being opposed to the first end surface, wherein the plurality of first magnetic layers project outward from the plurality of second magnetic layers in a planar direction perpendicular to the lamination direction.

2. The coil component of claim 1, wherein the second average particle size is two or more times as large as the first average particle size.

3. The coil component of claim 1, further comprising a cover layer disposed on one end of the magnetic laminate in the lamination direction and containing third soft magnetic metal particles having a third average particle size that is larger than the second average particle size, wherein the plurality of second magnetic layers project outward from the cover layer in the planar direction.

4. The coil component of claim 3, wherein the third average particle size is two or more times as large as the second average particle size.

5. The coil component of claim 3, wherein the third average particle size is within a range of 6 to 20 μm.

6. The coil component of claim 1, further comprising:

a cover layer disposed on one end of the magnetic laminate in the lamination direction and containing third soft magnetic metal particles having a third average particle size that is larger than the second average particle size; and another cover layer disposed on the other end of the magnetic laminate in the lamination direction and containing fourth soft magnetic metal particles having a fourth average particle size that is larger than the second average particle size.

7. The coil component according to claim 6, wherein the fourth average particle size is two or more times as large as the second average particle size.

8. The coil component according to claim 6, wherein the fourth average particle size is within a range of 6 to 20 μm.

9. The coil component of claim 1, wherein the coil conductor includes a first lead-out conductor extending through one of the plurality of second magnetic layers and connected to the first external electrode.

10. The coil component of claim 9, further comprising a cover layer disposed on one end of the magnetic laminate in the lamination direction and containing third soft magnetic metal particles having a third average particle size that is larger than the second average particle size, wherein the first lead-out conductor contacts with the cover layer.

11. The coil component of claim 1, wherein the coil conductor includes a second lead-out conductor extending through one of the plurality of second magnetic layers and connected to the second external electrode.

12. The coil component of claim 11, further comprising:

a cover layer disposed on one end of the magnetic laminate in the lamination direction and containing third soft magnetic metal particles having a third average particle size that is larger than the second average particle size; and another cover layer disposed on the other end of the magnetic laminate in the lamination direction and containing fourth soft magnetic metal particles having a fourth average particle size that is larger than the second average particle size, wherein the second lead-out conductor contacts with the other cover layer.

13. A circuit board comprising the coil component of claim 1.

14. An electronic device comprising the circuit board of claim 13.

15. A method of producing a coil component, comprising:

preparing a plurality of magnetic sheets containing first soft magnetic metal particles having a first average particle size;

providing a conductor pattern on each of the plurality of magnetic sheets;

providing a magnetic film on each of the plurality of magnetic sheets to obtain a plurality of composite sheets, the magnetic film containing second soft magnetic metal particles having a second average particle size that is larger than the first average particle size;

stacking together the plurality of composite sheets in a lamination direction to form a body laminate;

firing the body laminate to obtain a fired laminate;

dicing the fired laminate to obtain a chip laminate;

polishing a first end surface and a second end surface of the chip laminate, the first end surface extending along the lamination direction, the second end surface being opposed to the first end surface;

providing a first external electrode on the first end surface polished; and providing a second external electrode on the second end surface polished.

16. The method of producing a coil component of claim 15, further comprising preparing a cover layer sheet containing third soft magnetic metal particles having a third average particle size that is larger than the second average particle size, wherein in forming the body laminate, the plurality of composite sheets are stacked together with the cover layer sheet in the lamination direction such that the cover layer sheet is positioned on one end in the lamination direction.

* * * * *